United States Patent [19]

Jaeger et al.

[11] 4,223,788

[45] Sep. 23, 1980

[54] RECLOSABLE THERMOFORMED BLISTER-TYPE PACKAGE

[75] Inventors: Arthur Jaeger, West Chester; Richard Gunderlock, Lederach; Richard J. Harwood, Philadelphia, all of Pa.

[73] Assignee: Merck & Co., Inc., Rahway, N.J.

[21] Appl. No.: 961,429

[22] Filed: Nov. 16, 1978

[51] Int. Cl.[3] ..... B65D 37/00; B65D 55/00

[52] U.S. Cl. ..... 206/468; 206/45.23; 220/244; 220/314; 220/346; 403/100; 16/144

[58] Field of Search ..... 206/468, 467, 469, 470, 206/45.23; 16/138, 141, 144, 178, 179; 220/244, 252, 314, 322, 346; 403/100, 102, 324, 331

[56] References Cited

U.S. PATENT DOCUMENTS

| | | | |
|---|---|---|---|
| 3,205,521 | 9/1965 | McCaughey | 403/100 |
| 3,437,199 | 4/1969 | Jacobson | 206/470 |
| 3,563,592 | 2/1971 | Preston | 403/102 |
| 3,854,653 | 12/1974 | Engelsberger . | |
| 3,967,730 | 7/1976 | Driscoll | 206/467 |
| 4,133,429 | 1/1979 | Kuchenbecker | 206/468 |

FOREIGN PATENT DOCUMENTS

| | | | |
|---|---|---|---|
| 2124931 | 11/1972 | Fed. Rep. of Germany | 206/467 |
| 6708222 | 12/1968 | Netherlands | 206/470 |
| 927035 | 5/1963 | United Kingdom | 206/467 |

*Primary Examiner*—Herbert F. Ross

*Attorney, Agent, or Firm*—Thomas E. Arther; Mario A. Monaco; Rudolph J. Anderson, Jr.

[57] ABSTRACT

A rigid blister package includes a rigid thermoformed plastic cover piece and a flexible backing sheet, a score line for opening said package, and a slide fastener for reclosing the blister package, along with stops to hold the slide fastener in the open or closed position.

1 Claim, 5 Drawing Figures

RECLOSABLE THERMOFORMED BLISTER-TYPE PACKAGE

BACKGROUND OF THE INVENTION

This invention relates to packages, and more particularly to packages which are useful for display and for storage and reuse of the article being packaged.

Many present-day articles of manufacture for individual consumer use are individually packaged in socalled blister-type packages which are convenient for merchandising to the consumer. Such packages usually include a rigid or semirigid backing piece on which the item to be sold is placed; and the item is then held loosely in place on the card by attaching a clear semirigid, raised plastic cover which encloses the item and conforms generally to the shape of the item being packaged.

In blister packages of this type, the semirigid clear transparent cover or enclosure is usually sealed to the backing piece by a flange which extends beyond the raised transparent cover portion.

Other blister packages are provided for pharmaceutical and/or cosmetic items in solid, semisolid, or liquid form, designed either for one-time use or as a reusable package. These packages, in general structurally resemble the improved package of the present invention in that the rigid preformed transparent plastic portion of the package is sealed along its flanged edges to a flexible sheet comprising a foil-backed plastic material, as for example a laminated mylar foil. However, there is usually no positive method of reclosing such packages that avoids spillage of liquid contents.

SUMMARY OF THE INVENTION

It is an object of the present invention to provide a blister package for small items, which is provided with a positive reclosure device. There is no need with this particular package to employ additional equipment such as auxiliary clips or adhesive tape to effect positive reclosure of the blister package.

The blister package itself is of conventional construction in that a substantially rectangular sheet of plastic having a raised rigid thermoformed hollow plastic portion is sealed to a laminated foil/plastic backing sheet by means of a flange extending from the perimeter base of the said plastic body in a horizontal plane. The rigid plastic body is scored at the end so that the package may be opened by bending the package along the scored line, thus providing access to the contents of the package. The package of the present invention is provided with a slide closure, fabricated of rigid material. The slide closure is a band of rigid material which extends across the back of the package. The ends of said band are formed around the edge of the package adjacent so that the band may slide back and forth to enclose the scored end of the package, thus preventing bending of the backing sheet and opening of the package. The slide may also be moved along the package to a position where it does not enclose the scored part of the package, thus allowing the package to be bent back along the scored line and provide access to the package contents.

These and other objects, features, and advantages of the invention will become apparent from the specification and drawings.

DESCRIPTION OF THE PREFERRED EMBODIMENT

Figure 1:
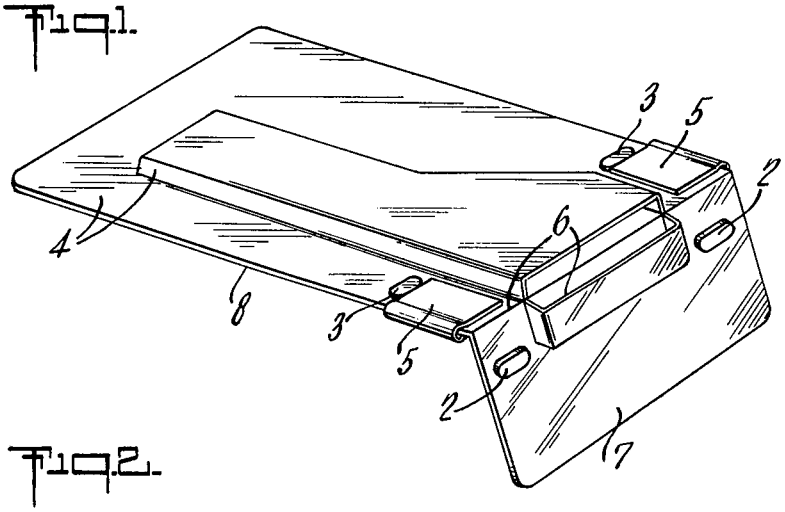
FIG. 1 is a perspective view of the entire package viewed from the raised plastic side of the package in open position.
Figure 2:
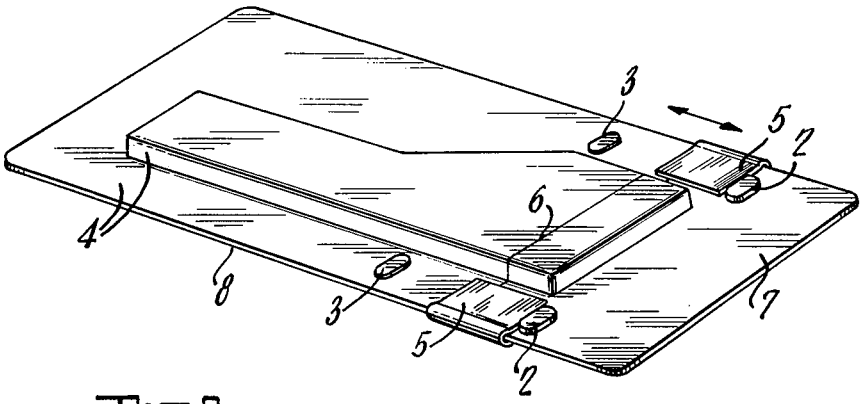
FIG. 2 is a perspective view of the entire package viewed from the raised plastic side of the package in closed position.

Referring now specifically to the drawings, and more specifically to FIGS. 1 and 2, the reclosable blister package includes a top layer 4 of thermoformed rigid transparent plastic with raised ribs 2 and 3 which are thermoformed into the top layer of the blister package. The raised ribs 2 are lower than raised ribs 3 so that the extruded or injection-molded rigid plastic slide 5 may be slid over end tab 7 and over the ribs 2 during assembly of the package.

In FIG. 2, there is a scored or notched line (6) across one end of the thermoformed plastic top layer from edge to edge providing a means to break open the package. As shown in this FIG. 2, the slide 5 is in the closed position to prevent bending back of tab 7 along the score line 6.

In FIG. 1, slide 5 is shown as having been moved to the position nearest raised ribs 3, thus exposing the score line 6 along its entire length and permitting the bending back of tab 7 along said score line, and providing access to the contents of said package.

Figure 3:
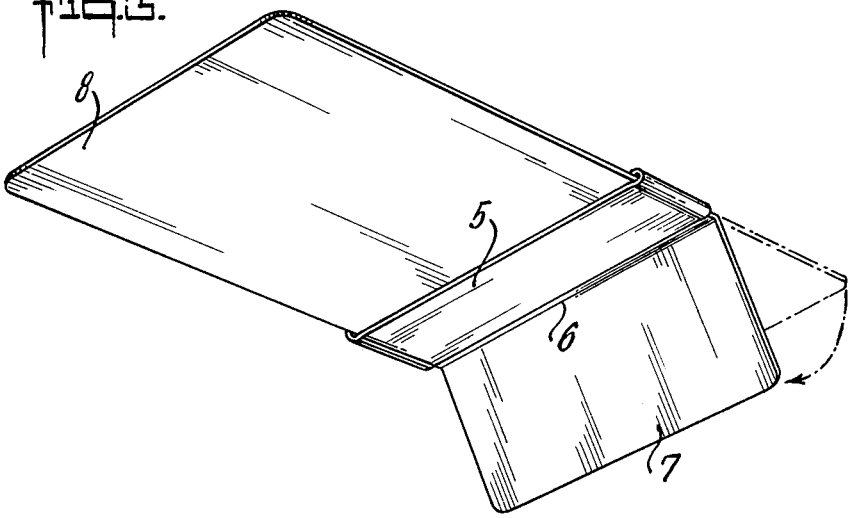
FIG. 3 is a perspective view of the reverse or bottom side of the package in open position, illustrating the slide closure as it appears from the reverse side.

In FIG. 3, which is the view of the reverse side of the package in the open position, there is shown the flexible plastic sheet sealed to the rigid thermoformed plastic top layer of the package of FIGS. 1 and 2. This flexible plastic sheet is continuous and covers the main body of the package (8) as well as the tab 7, which is bent back along score line 6. There is shown the back of slide 5 moved to the open position, allowing access to the package contents and preventing the accidental peeling of the flexible plastic sheet during subsequent openings and reclosings of the package.

Figure 4:
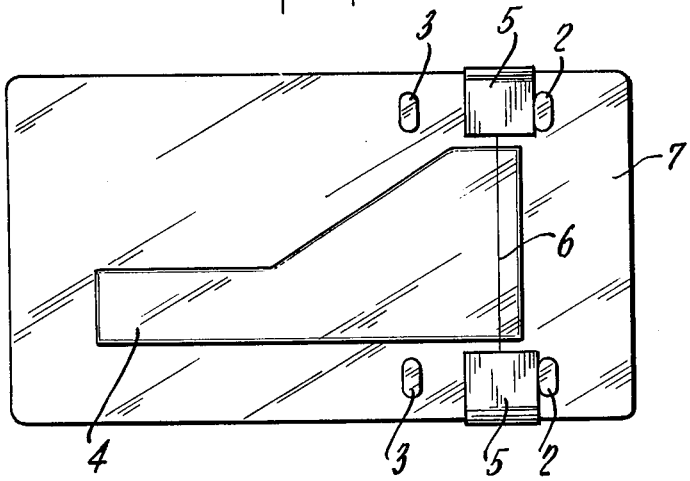
FIG. 4 is a top view of the package in closed position.

In FIG. 4, there is shown a top view of the package in the closed position, showing the raised portion of the thermoformed rigid transparent plastic top layer (4) of the package within the same plane as tab 7. This closure is positively secured by slide 5 being placed against the stops (2), preventing bending and thus opening of the package by bending back tab 7 along score line 6.

Figure 5:
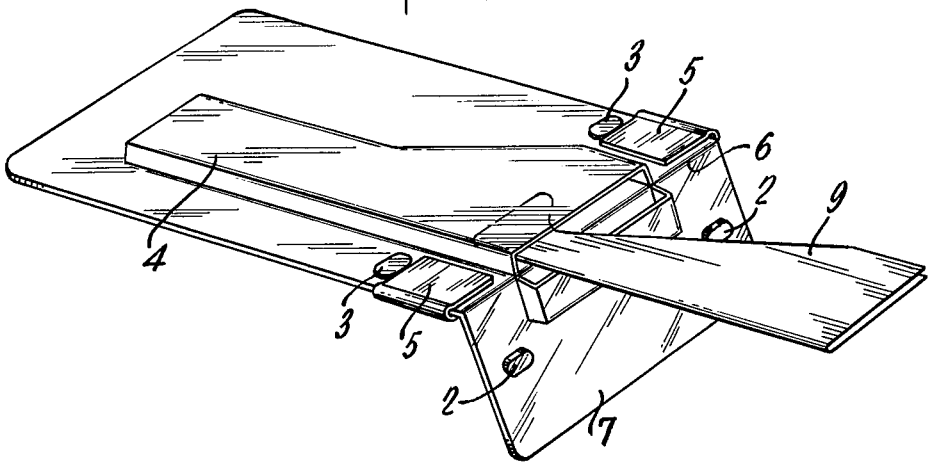
FIG. 5 is a perspective view taken from the top or front of the package, showing a partly removed applicator used in eye treatments.

FIG. 5, which shows the preferred embodiment of the invention in one open position occurring in actual use, shows an eye applicator device (9) partly removed from said package. In this view, there is shown tab 7 bent back into the open position. In order to allow such bending, slide 5 is advanced closer to stop 3, thus exposing the score line 6, permitting the bending back of tab 7 along score line 6 and exposing eye applicator 9, which can then be withdrawn and replaced as desired.

What is claimed is:

1. A blister package adapted for opening along a predetermined line and reclosing with a positive closure device comprising:

a substantially rectangular sheet of rigid plastic having a raised rigid thermoformed hollow plastic body portion having opposed top and bottom and lateral edges;

a score line intermediate the top and bottom edges parallel thereto and extending from side to side across said rectangular sheet;

a flexible plastic sheet sealed to said rectangular sheet thereby forming an enclosed hollow body portion adapted for storage of a small object protected from the atmosphere;

said score line spaced intermediate the top and bottom across the top end of said raised plastic body thereby providing a predetermined break line for access to package contents on bending back the top end;

a slide closure consisting of a rigid band of plastic extending from side to side across the back of said package and formed around the sides of said package so that substantial bending of said package is prevented by said slide;

a pair of raised ribs spaced along the edges of said rectangular sheet spaced parallel to and between said score line and said top edge;

said pair of raised ribs acting as slide stops and spaced to allow slide to be positioned over score line when advanced towards top edge of said package;

a second pair of raised ribs spaced along the edges of said rectangular sheet spaced to and between said score line and said bottom edge; and said second pair of raised ribs acting as slide stops and spaced to allow slide to be slid clear of said score line, thus allowing bending back of said package and permitting access to the contents thereof.

* * * * *